US006267802B1

(12) United States Patent
Baldrey et al.

(10) Patent No.: US 6,267,802 B1
(45) Date of Patent: Jul. 31, 2001

(54) COMPOSITION APPARATUS AND METHOD FOR FLUE GAS CONDITIONING

(75) Inventors: Kenneth Eugene Baldrey, Denver; Ramon Edward Bisque, Golden; Michael Dean Durham, Castle Rock; Douglas W. Jackson, Lakewood, all of CO (US)

(73) Assignee: ADA Environmental Solutions, LLC, Littleton, CO (US)

( * ) Notice: Subject to any disclaimer, the term of this patent is extended or adjusted under 35 U.S.C. 154(b) by 0 days.

(21) Appl. No.: 09/335,428

(22) Filed: Jun. 17, 1999

(51) Int. Cl.[7] ..... B03C 3/013

(52) U.S. Cl. ..... 95/58; 95/72; 96/52; 96/74; 252/192; 423/243.08

(58) Field of Search ..... 95/58, 65, 71, 95/72, 59; 96/27, 53, 74, 52; 252/192; 423/243.08, 244.07

(56) References Cited

U.S. PATENT DOCUMENTS

| | | | |
|---|---|---|---|
| 3,058,803 | 10/1962 | Hinkel, Jr. et al. | 23/88 |
| 3,284,990 | 11/1966 | Orne | 55/5 |
| 3,523,407 | 8/1970 | Humbert | 55/106 |
| 3,632,306 | 1/1972 | Fisher et al. | 23/178 |
| 3,665,676 | 5/1972 | McKewen | 55/4 |
| 3,783,158 | 1/1974 | Platzke et al. | 423/49 |
| 3,807,137 | 4/1974 | Romell | 55/10 |
| 3,928,537 | 12/1975 | Saitoh et al. | 423/243 |
| 3,932,587 | 1/1976 | Grantham et al. | 423/242 |
| 4,042,348 | 8/1977 | Bennett et al. | 55/5 |
| 4,043,768 | 8/1977 | Bennett et al. | 55/5 |
| 4,070,424 | 1/1978 | Olson et al. | 261/142 |
| 4,113,447 | 9/1978 | Bennett et al. | 55/5 |
| 4,121,945 | 10/1978 | Hurst et al. | 106/288 |
| 4,123,234 | 10/1978 | Vossos | 55/5 |
| 4,132,535 | 1/1979 | Rivers, Jr. et al. | 55/23 |
| 4,177,043 | 12/1979 | Albanese | 55/5 |
| 4,197,278 | 4/1980 | Gehri et al. | 423/242 |
| 4,222,993 | 9/1980 | Holter et al. | 423/243 |
| 4,226,601 | 10/1980 | Smith | 44/10 |

(List continued on next page.)

FOREIGN PATENT DOCUMENTS

| | | | |
|---|---|---|---|
| 2015899 | 9/1979 | (GB) . | |
| 55-61945 * | 5/1980 | (JP) | 95/71 |
| 55-61946 * | 5/1980 | (JP) | 95/71 |
| WO 96/404436 | 12/1996 | (WO) . | |

OTHER PUBLICATIONS

Calgon Corporation Paper Entitled "Relative Efficiency of Phosphates used in Boiler Water Conditioning"; 4 pages, Oct. 29, 1998.

Durham et al; "Bench–Scale and Pilot–Plant Evaluation of Additives for Improved Particle Collection in Electrostatic Precipitators"; Tenth Annual Coal Preparation, Utilization, and Environmental Control Contractors Conference, Pittsburgh Energy Technology Center; Jul. 18–21, 1994; pp. 1–7.

Bustard et al.; "Non–Toxic Additives for Improved Fabric Filter Performance"; Tenth Annual Coal Preparation, Utilization, and Environmental Control Contractors Conference, Pittsburgh Energy Technology Center; Jul. 18–21, 1994; pp. 1–8.

*Primary Examiner*—Richard L. Chiesa
(74) *Attorney, Agent, or Firm*—Sheridan Ross P.C.

(57) ABSTRACT

The method and apparatus of the present invention are directed to conditioning particulate-containing gas streams using novel additives. The additive is an organometallic salt, preferably of a carboxylic acid, that decomposes in the gas stream to produce mobile metal compounds that significantly reduce the resistivity of the particles. The additive is particularly effective under hot-side conditions when used to condition particles to be collected by an electrostatic precipitator.

47 Claims, 7 Drawing Sheets

U.S. PATENT DOCUMENTS

| | | | |
|---|---|---|---|
| 4,239,504 | 12/1980 | Polizzotti et al. | 55/5 |
| 4,247,321 | 1/1981 | Persinger | 71/59 |
| 4,306,885 | 12/1981 | Kober et al. | 55/5 |
| 4,325,711 | 4/1982 | Kober et al. | 55/5 |
| 4,337,231 | 6/1982 | Yaguchi et al. | 423/243 |
| 4,533,532 | 8/1985 | Gebhard et al. | 423/244 |
| 4,542,844 | 9/1985 | Olesen et al. | 227/7 |
| 4,581,210 | 4/1986 | Teller | 423/242 |
| 4,600,569 | 7/1986 | Yoon | 423/243 |
| 4,604,269 | 8/1986 | Yoon | 423/242 |
| 4,615,871 | 10/1986 | Yoon | 423/243 |
| 4,629,572 | 12/1986 | Leitz et al. | 210/714 |
| 4,738,690 | 4/1988 | Radway et al. | 55/5 |
| 4,749,492 | 6/1988 | Berrigan, Jr. et al. | 210/616 |
| 4,777,024 | 10/1988 | Epperly et al. | 423/235 |
| 4,778,598 | 10/1988 | Hoffman et al. | 210/710 |
| 4,793,981 | 12/1988 | Doyle et al. | 423/239 |
| 4,822,577 | 4/1989 | Epperly et al. | 423/243 |
| 4,869,846 | 9/1989 | Mouché et al. | 252/192 |
| 4,885,139 | 12/1989 | Sparks et al. | 422/169 |
| 4,886,579 | 12/1989 | Clark et al. | 162/111 |
| 4,888,158 | 12/1989 | Downs | 423/242 |
| 4,891,195 | 1/1990 | Lin | 423/243 |
| 4,908,194 | 3/1990 | Hooper | 423/235 |
| 4,954,324 | 9/1990 | Hooper | 423/239 |
| 5,032,154 | 7/1991 | Wright | 55/106 |
| 5,066,316 | 11/1991 | Ikeda | 55/122 |
| 5,089,142 | 2/1992 | Turunc | 210/728 |
| 5,106,601 | 4/1992 | Chang et al. | 423/235 |
| 5,215,575 | 6/1993 | Butler | 75/744 |
| 5,256,198 | 10/1993 | Sinha | 106/708 |
| 5,284,636 | 2/1994 | Goff et al. | 423/235 |
| 5,312,605 | 5/1994 | Levendis et al. | 423/210 |
| 5,351,630 | 10/1994 | Lister et al. | 110/165 |
| 5,352,423 | 10/1994 | Levendis et al. | 423/235 |
| 5,356,597 | 10/1994 | Wright et al. | 422/169 |
| 5,443,805 | 8/1995 | Beér et al. | 423/235 |
| 5,449,390 | 9/1995 | Duncan et al. | 55/222 |
| 5,547,495 | 8/1996 | Wright | 96/74 |
| 5,681,384 | 10/1997 | Liskowitz et al. | 106/710 |
| 5,707,422 * | 1/1998 | Jacobsson et al. | 95/58 X |
| 5,785,936 | 7/1998 | Levendis | 423/210 |
| 5,795,367 * | 8/1998 | Kennedy et al. | 96/27 X |
| 5,810,920 | 9/1998 | Ueshima et al. | 106/697 |
| 5,833,736 * | 11/1998 | Durham et al. | 95/71 |
| 5,855,649 | 1/1999 | Durham et al. | 95/71 |
| 5,893,943 | 4/1999 | Durham et al. | 95/65 |
| 5,902,380 * | 5/1999 | Tomimatsu et al. | 96/27 |
| 6,001,152 * | 12/1999 | Sinha | 95/58 |

* cited by examiner

COMPOSITION APPARATUS AND METHOD FOR FLUE GAS CONDITIONING

FIELD OF THE INVENTION

The present invention is related generally to the conditioning of gas streams for particulate removal and specifically to the conditioning of gas streams for particulate removal using an electrostatic precipitator, particularly at high temperatures.

BACKGROUND

Environmental standards for particulate emissions by coal-fired electrical power plants, petroleum refineries, chemical plants, pulp and paper plants, cement plants, and other particulate-emitting facilities are becoming increasingly more demanding. For example, air quality standards in the United States now require power plants to remove more than 99% of the flyash produced by coal combustion before the flue gas can be discharged into the atmosphere. As environmental standards tighten, there is a corresponding need for a more efficient means of particulate removal.

An electrostatic precipitator is a commonly used device for removing undesired particles from the gas streams produced by plants and refineries. As used herein, "undesired particles" refers to any particulate matter such as flyash, that is desired to be removed from a gas stream. In a typical electrostatic precipitator, undesired particle-laden gases pass negatively charged corona electrodes which impart a negative charge to the undesired particles. The charged particles then migrate towards positively charged collection plates and are removed by various techniques, including sonic horn blasts or rapping of the collection plates. Electrostatic precipitators may employ a common stage or separate stages for both the charging and collection of undesired particles.

In utility applications, there are two types of electrostatic precipitators. Cold-side electrostatic precipitators are located on the downstream side of the air preheater or heat exchanger (which transfers heat from the flue gas to the air to be fed into the furnace) and therefore operate at relatively low temperatures (i.e., temperatures of no more than about 200° C.). Hot-side electrostatic precipitators are located on the upstream side of the air preheater and therefore operate at relatively high temperatures (i.e., more than about 250° C.).

Many hot-side electrostatic precipitators suffer from problems related to the resistivity of collected undesired particles. Such problems can cause a deterioration of the particulate collection efficiency of the electrostatic precipitator and excessive power consumption. These problems can be caused by sodium depletion of collected undesired particles on the collection plates, inherently high resistivity of undesired particles, or resistivity problems during low load or at colder temperatures.

Additives, such as sulfur trioxide, ammonia, and various surface conditioning additives (such as sulfuric acid) that are effective under cold-side conditions are generally ineffective under hot-side conditions because of different charge conduction mechanisms. Referring to FIG. 1, under cold-side conditions (which exist at operating temperatures less than the critical temperature) surface conduction of charge is the predominant charge conduction mechanism while under hot-side conditions (which exist typically at operating temperatures more than the critical temperature) volume conduction of charge is the predominant charge conduction mechanism. As used herein, the "critical temperature" is the temperature corresponding to the highest attainable resistivity of an undesired particle (which is commonly located at the top of a bell-shaped curve as shown in FIG. 1).

One conditioning method for controlling high temperature resistivity that has had some success under hot-side conditions has been bulk addition of sodium into the coal feed to the boiler. Typically, from about 0.5 to about 3% by weight sodium is added to the coal feed as a sodium sulfate or soda ash. The sodium is co-fired with the coal in the boiler and is incorporated into the undesired particles as various sodium oxides. However, the bulk addition of sodium to the coal feed can cause serious problems, such as boiler slagging due to high sodium flyash, the consumption of excessive amounts of alkali material and a commensurate increase in operating costs, higher gas temperatures downstream of the boiler that can aggravate duct and electrostatic precipitator structural problems, and an inability to supply the additive on an intermittent or as-needed basis.

SUMMARY OF THE INVENTION

Objectives of the present invention include providing an electrostatic precipitator that can remove sufficient undesired particles from a gas stream to comply with pertinent environmental regulations; increasing the efficiency of electrostatic precipitators in the removal of undesired particles from a gas stream, preferably without significantly increasing capital and operating costs and without undue power consumption; increasing electrostatic precipitator efficiency without the use of toxic additives; increasing electrostatic precipitator efficiency by methods and apparatuses that are readily adaptable to existing designs; and reducing undesired particle reentrainment during removal of undesired particles from a collection surface. Related objectives include increasing electrostatic precipitator efficiency without inducing boiler slagging, without excessive consumption of alkali material, without increasing gas stream temperatures downstream of the boiler, and using an additive that can be supplied on an intermittent or as-needed basis.

In one embodiment of the present invention, a process is provided for removing undesired solid particles from a gas stream that can realize these and other objectives. The process includes the steps of:

(a) contacting with the gas stream a composition including an organometallic compound;

(b) collecting on at least one collection surface in a collection zone a solid aggregate including at least a portion of the composition or a derivative(s) thereof and at least a portion of the undesired solid particles; and (c) removing the agglomerate from the collection surface. As used herein, "agglomerate" refers to a cluster or accumulation of undesired particles and/or particles of the organometallic compound or a derivative thereof; a "carboxylic acid" refers to any acid having both a carboxyl (hydroxyl (OH) and carbonyl (C=0)) group of the form R-COOH where R is a linked organic structure to the carboxylic group (COOH); a "collection surface" is any surface which collects undesired particles (e.g., an electrode or a porous filtration surface); and "contacting" refers to any technique for inputting the composition into the gas stream, such as by spray nozzles, drip emitters, venturi eductors and the like.

The organometallic compound is preferably any organic compound that decomposes at the gas stream temperature to produce an inorganic metal oxide after injection into the gas stream. "Decomposition" refers to the constituents of the organometallic forming other compounds as a result of thermal or chemical decomposition, chemical reaction, or otherwise. The inorganic metal oxide is preferably an oxalate, carbonate, hydroxide, oxide and mixtures thereof with a carbonate and oxide being more preferred. It is desired that the organometallic compound have a melting point that is less than and a boiling point that is more than (i.e., is substantially nonvaporizable or free of vaporization) at the temperature of the gas stream to produce a liquid additive of the injection and a relatively low molecular weight (i.e., preferably no more than about 180 daltons). More preferably, the organometallic compound is a monocarboxylic acid (metal) salt and even more preferably the monocarboxylic acid salt has 3 or fewer carbon atoms (the carbon of the terminal group being counted as part of the chain) and is selected from the group consisting of a metal acetate, a metal formate, a metal propionate and mixtures thereof and even more preferably a metal acetate, a metal formate and mixtures thereof. As will be appreciated, a metal salt of a carboxylic acid is formed when a metal cation substitutes for the H in the carboxylic group. Accordingly, the formula for a metal salt of a carboxylic acid is R-COOM, where R is a linked organic structure and M is the metal. Examples of metal salts of carboxylic acids that can be decomposed at the gas stream temperature include sodium acetate, $CH_3COONa$, and sodium formate, HCOONa.

As will be appreciated, the temperature of the gas stream under hot-side conditions is typically at least about 250° C. (480° F.) and more typically ranges from about 270° C. (520° F.) to about 480° C. (900° F.).

While not wishing to be bound by any theory, it is believed that molecular decomposition of the organometallic compound at the gas stream temperature yields available metal ion charge carriers on the undesired particle(s) and/or releases the metal into the agglomerate which provides additional charge conduction capability to the agglomerate and thereby decreases resistivity and retards deterioration of electrostatic precipitator performance in response to high undesired particle resistivity.

At least most of the metal(s) in the organometallic compound is preferably a monovalent alkaline earth metal and more preferably is sodium, potassium, lithium and mixtures thereof, with sodium, potassium, and mixtures thereof being even more preferred. The organometallic additive can thus be selected from, a number of widely available, inexpensive, nontoxic, and substantially noncorrosive compounds.

The additive composition preferably includes a volatile carrier fluid, such as water, which vaporizes readily at the gas stream temperature (i.e., has a boiling point that is less than the gas stream temperature). It is preferred that substantially all of the carrier fluid vaporize before the salt or derivative(s) thereof contacts the collection surface, which is commonly within no more than about 5 seconds after contact of the composition with the gas stream.

The composition can further include a decomposition agent to cause decomposition of the carboxylic acid salt after contact thereof with the gas stream. As used herein, "decomposition agent" refers to any substance that lowers the temperature and/or increases the rate at which the salt decomposes into one or more other compounds and/or causes the salt to form desired products in the gas stream. The decomposition agent typically catalyzes thermal decomposition and/or reacts with the salt to form desired products. By way of example, for a metal formate a decomposition agent such as NaOH can be employed to form the end products, metal carbonate and $H_2$.

It is preferred that the decomposition agent has a boiling point that is above the gas stream temperature. Otherwise when the blended additive is injected into the gas stream, substantial amounts of the decomposition agent may volatilize before the decomposition reaction is substantially completed. It is desired that the decomposition reaction occur either in the gas stream or after the additive particles are collected on the collection surface. Preferred decomposition agents include one or more alkali metal hydroxides.

The additive composition can include one or more of the above-noted components. Preferably, the additive composition includes at least about 1.7% by weight of the metal carboxylic acid salt, at least about 97.3% by weight of the carrier fluid, and at least about 1.0% by weight of the decomposition agent.

In another embodiment of the present invention, an additive for improving charge conduction in electrostatically collected undesired solid particles is provided. The additive includes:

(a) at least about 2% by weight of a metal salt of a carboxylic acid and (b) a vaporizable carrier fluid.

As noted, the additive can further include a decomposition agent to cause decomposition of the salt after contact of the salt with the gas stream.

In yet another embodiment of the present invention, a particle removal process is provided that includes the steps of:

(a) contacting with the gas stream a composition including an organometallic compound; and (b) collecting at least most of the undesired particles and at least a portion of the organometallic compound or a derivative thereof on a collection surface to form on the collection surface a solid agglomerate including the undesired particles and the organometallic compound or a derivative thereof. The collection surface is located between a combustion zone where the gas stream is generated and a heat exchanger that transfers heat from the gas stream to an oxygen-containing gas to be introduced into the combustion zone.

Finally, another embodiment of the present invention is directed to a system for removing undesired particles from a gas stream that includes:

(a) a housing;

(b) an input for introducing an input gas stream into the housing;

(c) an output for removing an output gas stream from the housing;

(d) an additive contacting means for contacting with the input gas stream a composition including an organometallic compound that decomposes in the gas stream to form an inorganic metal oxide; and (e) a collection surface (such as a filtration surface or electrode) that is positioned in the housing between the input and the output to collect at least a portion of the undesired particles and at least a portion of the composition on the collection surface.

The additive contacting means can be any device for contacting the additive composition, either in solid or liquid form, with the gas stream. Typically, the additive contacting means is one or more spray nozzles, drip emitters, venturi eductors and the like. A suitable control feedback circuit can be used to selectively control the addition of the additive to the gas stream in response to the resistivity of the collected undesired particles or an electrical parameter (i.e., voltage, current or resistance) of the electrostatic precipitator.

In one configuration, the collection surface is a collecting electrode and the system further includes:

(f) a power supply having positive and negative terminals and (g) at least one charging electrode electrically connected to a terminal of the power supply and positioned in the housing relative to the input gas stream to impart a charge to the undesired particles and composition particles in the input gas stream. The collecting electrode is electrically connected to the other of the terminals of the power supply and is positioned in the housing relative to the charging electrode to accumulate the charged particles on the collecting electrode.

The additive of the present invention can have a number of advantages relative to existing additives, particularly under hot-side conditions. When the additive is added to the gas stream, the electrostatic precipitator, even under hotside conditions, can remove sufficient undesired particles to form a gas stream that is in compliance with pertinent environmental regulations. The additive permits the electrostatic precipitator to maintain a high level of particulate removal efficiency at a relatively low level of power consumption over time with no significant deterioration in electrostatic precipitator performance. The additive can be readily employed with existing electrostatic precipitators simply by retrofitting the precipitator with devices, such as nozzles or drip emitters, for injecting the additive into the gas stream. The injection of the additive into the gas stream upstream of the electrostatic precipitator rather than the addition of the additive to the coal feed substantially inhibits boiler slagging, avoids excessive consumption of the additive, and avoids increasing the gas stream temperature downstream of the boiler.

DETAILED DESCRIPTION

Figure 1:
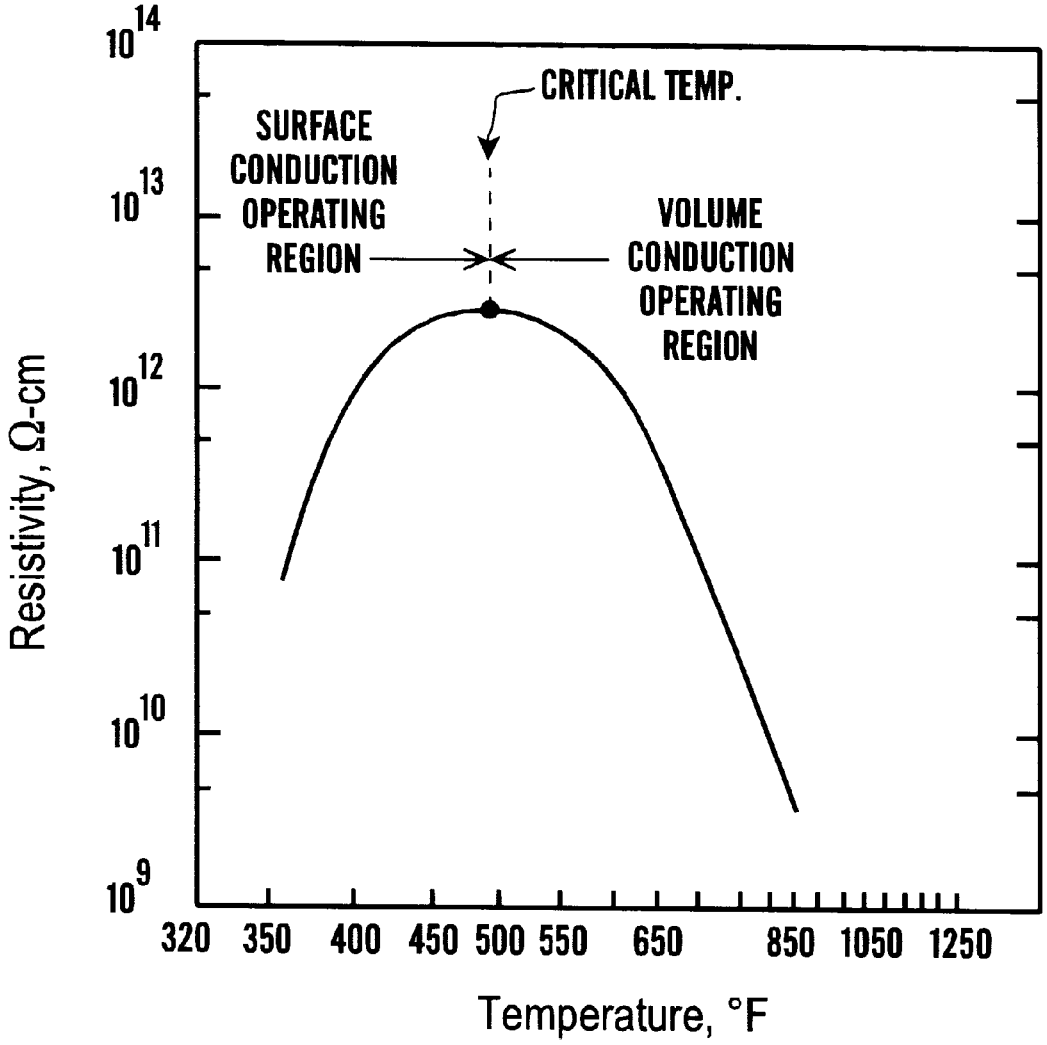
FIG. 1 PRIOR ART
FIG. 1 is a graph showing the relationship between particle temperature and particle resistivity for typical flyash particles.
Figure 2:
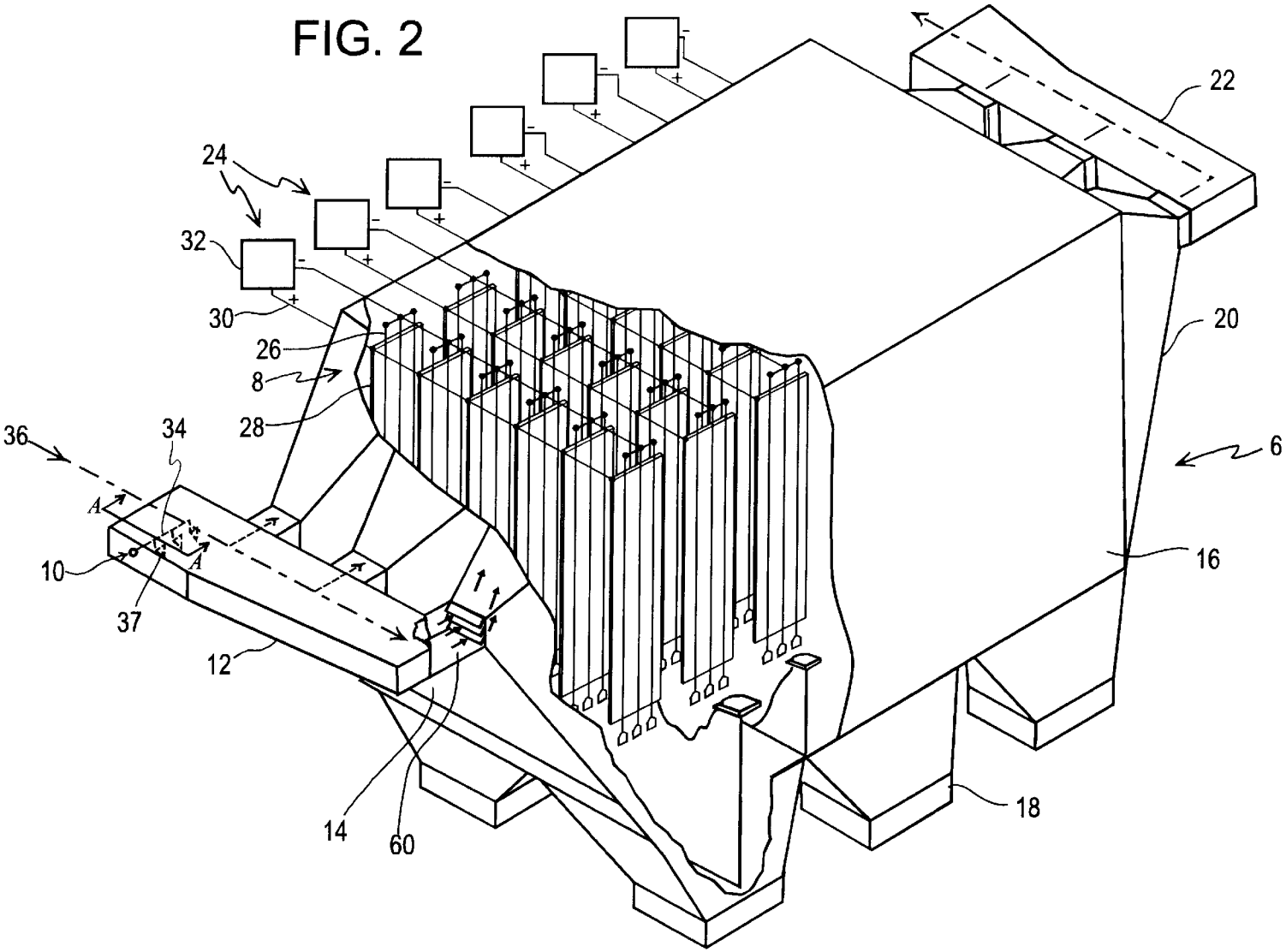
FIG. 2 is a perspective view of an embodiment of the present invention in an electrostatic precipitator.
Figure 3:
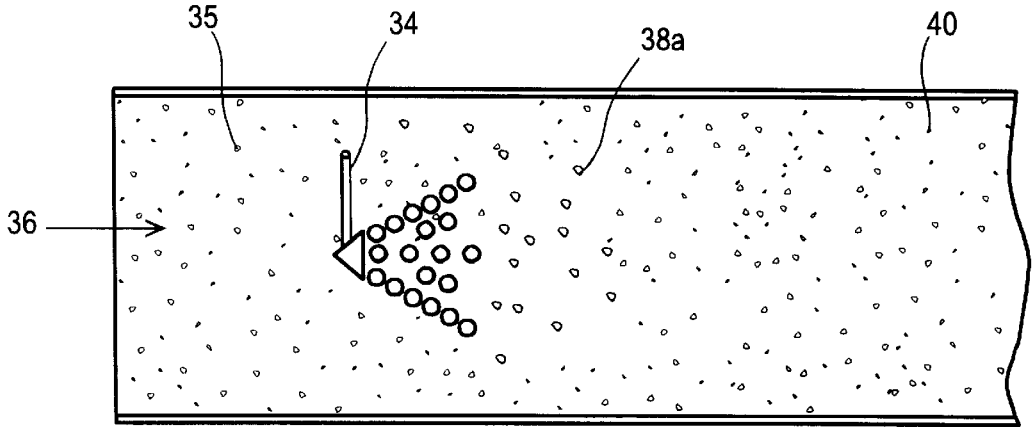
FIG. 3 is a cut away view along line A—A of FIG. 2 showing the additive injection device spraying droplets of the additive composition into the gas stream.

FIGS. 2 and 3 depict an embodiment of the present invention as implemented in an electrostatic precipitator for removal of undesired particles such as fly ash from a gas stream. The electrostatic precipitator includes housing assembly 6, precipitating assembly 8, and additive injection assembly 10. The housing assembly 6 includes an input duct 12, one or more input plenums 14, shell 16, one or more hoppers 18, one or more output plenums 20, and output duct 22.

The precipitating assembly 8 includes a plurality of sections 24. Each section 24 includes a plurality of alternately disposed discharge electrodes 26 and collection plates 28, a corresponding plurality of electrical conductors 90, and an interconnected power supply 32. The negative and positive terminals of the power supply 32 are connected to the discharge electrodes 26 and collection plates 28, respectively.

The additive injection assembly 10 includes a reservoir (not shown) and an interconnected feed line 34 and plurality of nozzles 37. As will be appreciated, the gas stream may be contacted with the additive composition continuously or intermittently and by many different methods. Additive injection assembly 10 achieves contacting by atomizing a composition including a carrier fluid and a carboxylic acid salt or a precursor thereof into the gas stream 36 in the form of droplets 38. Atomization may be realized by a number of different methodologies including spraying the composition through a nozzle. To enhance charging of the droplets, particularly if an anionic or nonionic salt is employed, electrostatic injection nozzles can be utilized. While preferred, a carrier fluid is not required to disperse additive particles in the gas stream 36. By way of example, additive particles 40 may be simply dripped into the gas stream 36 by a suitable device (e.g., a drip emitter).

As illustrated, additive injection assembly 10 should be located upstream of the precipitating assembly 8. Preferably, the additive injection assembly 10 is disposed so as to provide a sufficient distance between the additive injection assembly 10 and the nearest of the collection plates 28 such that, prior to contacting the nearest collection plate 28, a substantial portion of the carrier fluid, preferably at least about 90% and more preferably at least about 95% by weight, has separated from the additive and a substantially uniform dispersion of additive particles 40 across the gas stream 36 has been attained. By way of illustration, the preferred Mean Sauter Diameter of the droplets 38 upon injection into the gas stream is from about 10 to about 100 micrometers and of the droplets 38*a* after vaporization of the carrier fluid from about 1 to about 10 micrometers. A further reduction in the Mean Sauter Diameter of the droplets 38*a* to particle 40 can thereafter occur due to decomposition of the organometallic compound into compounds that are vaporizable and/or nonvaporizable under the operating conditions of the gas stream. Additive injection assembly 10 may be advantageously located in input duct 12 with nozzles 37 evenly spaced across and within the gas stream 36 as illustrated.

The gas stream 36 can be deflected by baffles 60 before contacting collection plates 28 to achieve a more uniform incidence of undesired particles 35 and additive particles 40 on collection plates 28, thereby yielding an agglomerate of a more uniform thickness on collection plates 28.

As noted, the additive is a metal organic (organometallic) compound that decomposes at the temperature of the gas stream. It is desired that the organometallic compound decompose to produce a metal oxide. Preferably, the decomposition occurs predominantly after introduction of the additive into the gas stream and therefore either before or after the organometallic compound or derivative thereof contacts the collection plate(s).

Preferably, the additive is a carboxylic acid metal salt or precursor thereof. More preferably, the additive is a metal salt of formic acid, acetic acid propionic acid and mixtures thereof, with metal formate, metal acetate and mixtures thereof being even more preferred. Metal acetate and metal formate thermally decompose to produce, inter alia, a metal oxalate. The metal oxalate can further decompose to produce a nonvaporizable metal carbonate or a metal hydroxide and a vaporizable carbon monoxide/dioxide and/or hydrogen gas.

Preferred metals are alkaline earth metals and more preferred metals are sodium, potassium, lithium and mixtures thereof, with sodium and potassium being more preferred. For reasons of cost, performance, and wider range of temperature application, sodium organometallic salts are even more preferred.

While not wishing to be bound by any theory, it is believed that the surprising and unexpected impact of the organometallic compound on hot-side electrostatic precipitator performance is caused by molecular decomposition of the organometallic compound to form metal charge carriers on the undesired particles. Surprisingly, the organometallic compound appears to yield far more available (alkali) metal ion charge carriers on the undesired particles compared to either injection of inorganic (alkali) metal compounds as liquid spray without decomposition or inorganic (alkali) metal compounds introduced into the boiler as part of the coal feed and thereafter contained in the undesired flyash particles. Additionally, the organometallic compound is believed to decompose to produce a number of particles that are smaller than the initially injected droplets and the droplets after the carrier fluid is vaporized. This provides a finer dispersion of the additive and its derivatives (i.e., more surface area) throughout the gas stream and therefore provides more effective dispersion of the additive particles throughout the agglomerate on the collection plate.

The additive composition can further include a decomposition agent to induce (catalyze) or cause (via a chemical reaction) molecular decomposition of the organometallic compound at the same or a lower temperature (compared to the decomposition of the organometallic compound alone) to form alkali metal ion charge carriers on the undesired particles. Preferred decomposition agents include alkali metal hydroxides and mixtures thereof. Specific examples of decomposition agents include hydroxides and oxides such as in the following reactions:

(a) $CH_3COONa \xrightarrow{NaOH(CaO)} CH_4 + Na_2CO_3$ (b) $HCOONa + NaOH \rightarrow Na_2CO_3 + H_2$ In each case, a decomposition product is an inorganic oxide, namely a sodium carbonate. A particularly preferred decomposition agent is a hydroxide when the additive is a metal formate.

The specific constituents of the additive composition depend on the identity of the carrier fluid, the desired size and amount of additive particles 40 to be introduced into the gas stream 36, and the size of the droplet 38 to be injected into the gas stream 36. Preferably, the composition includes from about 0.2 to about 40 and more preferably from about 2 to about 20% by weight of the organometallic compound and from about 0.1 to about 24 and more preferably from about 1 to about 12% by weight of the decomposition agent, with the remainder being the carrier fluid. The concentration of the decomposition agent is preferably at least about 50% and more preferably at least about 80% of the stoichiometric ratio relative to the concentration of the organometallic compound. For metal formate as the additive, the molar ratio of the decomposition agent (e.g., hydroxide) to the metal formate preferably ranges from about 1:0.5 to about 1:1.5 and more preferably from about 1:0.8 to about 1:1.2.

Figure 4:
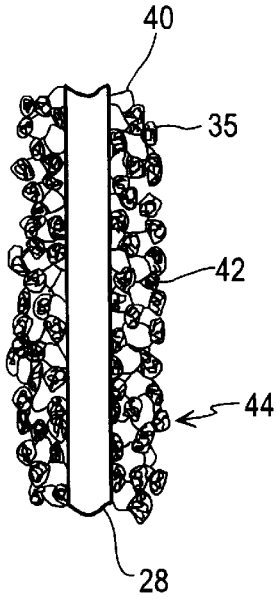
FIG. 4 is a side view of a collection plate showing an accumulation of additive particles and undesired particles on the collection plate.

With reference to FIGS. 2–4, the operation of the system will now be described. The gas stream 36 containing the undesired particles 35 is passed through the input duct 10 and the input plenums 14 into the electrostatic precipitator shell 16. Before entering the electrostatic precipitator shell 16, the gas stream 36 passes the additive injection assembly 10. The additive injection assembly 10 disperses a plurality of droplets 38 of the additive composition into the gas stream 36.

The temperature of the additive before injection can be important. Preferably, the temperature of the additive is below the decomposition temperature of the organometallic compound as it is desired that decomposition occur predominantly after injection of the compound into the gas stream. Although the decomposition temperature can be the thermal decomposition temperature, it is also possible that the decomposition is a result of a chemical reaction. In the latter case, it is important that the reactants be introduced together in the same droplet to ensure contact between the reactants. The chemical reaction can be retarded before injection thermally (by providing a low pre-injection temperature and therefore slow reaction kinetics) and/or chemically using a retardant or suppressant that vaporizes rapidly upon introduction into the gas stream to permit the chemical reaction to proceed to substantial completion.

As noted, the contacting of the additive with the gas stream can be facilitated by use of a carrier fluid. The carrier fluid can be any gas or liquid that is nontoxic, substantially odorless, and capable of transporting the additive over a desired distance. Additionally, in the case of a liquid carrier fluid, the carrier should be a solvent for the additive utilized. Preferably, the carrier fluid is a liquid, such as water, that readily and rapidly vaporizes at the temperature and pressure to which the gas stream is subjected.

The specific desired concentration of the organometallic compound to be dispersed in the gas stream 36 is established primarily based upon the concentration and the size distribution of the undesired particles 35 in the gas stream 36 and the desired concentration of the undesired particles 35 in the gas stream 36 after treatment. In general, however, the concentration of organometallic compound 36 preferably ranges from about 0.05 to about 1% by weight (relative to the total weight of the additive particles and the undesired particles in a selected volume of the gas stream). The additive-to-ash weight ratio (ATA) preferably ranges from about 1:2000 to about 1:50 and more preferably from about 1:1000 to about 1:200.

After the droplets 38 are injected into the gas stream 36, the droplets 38 are carried downstream by the gas stream 36. As the droplets 38 are carried downstream, the droplets 38 decrease in size to form smaller droplets **38*a* and even smaller particles 40**.

The successive size reductions are commonly by a different mechanism. The first size reduction is caused by the vaporization of the carrier fluid. A second, commonly later, size reduction may occur due to the decomposition of the organometallic compound into various compounds, some of which may be volatile gases. The gases are expelled into the gas stream, thereby reducing the mass and size of the entrained additive particles.

In any event, a large number of finely sized particles 40 (containing the organometallic salt and/or decomposition product thereof) are formed from the additive composition before the particles 40 contact the collection surface. The Sauter Mean Diameter of the particles 40 is believed to be from about 1 to about 5 micrometers. The finely sized particles 40 are dispersed substantially uniformly throughout the gas stream.

The vaporization time for the liquid carrier fluid in a droplet 38 depends primarily on the size of the droplet 38, the volatility of the liquid carrier fluid, and the temperature, pressure, and composition of the gas stream 36. Generally, the vaporization time for the liquid carrier fluid is less than about two seconds and more generally less than about one second.

After vaporization of the liquid carrier fluid, the additive particles 38*a* and/or 40 contact the collection plates 28. The temperature of both the collection plate surface and the agglomerate of the undesired particles 35 and the additive particles 40 collected on the surface is preferably at least about 100° F. above the condensation temperature of water vapor in the gas stream 36. Further, the temperature of both the collection plate surface and the agglomerate is preferably above the condensation temperature of the vaporized liquid carrier fluid.

The gas stream 36 containing the undesired particles 35 and the dispersed additive particles 40 enters the electrostatic precipitator shell 16. Discharge electrodes 26 impart a negative electrical charge to the undesired particles 35 and the additive particles 40. The negatively charged particles adhere to the positively charged collection plates 28. As the input gas stream moves away from the upstream section 24 to the downstream section 24, an increasing percentage of the undesired particles 35 and the additive particles 40 accumulate on the collection plates 28.

FIG. 4 is a side view of a portion of a collection plate that contains an agglomerate of the undesired particles 35 and the additive particles 40. For illustration purposes only, the size and number of the particles 40 are exaggerated relative to the size and number of the undesired particles 35. As will be appreciated, the particles 40 are commonly much smaller and significantly less numerous than the particles 35. As depicted, after contacting collection plate 28 the additive particles 40 are trapped in the interparticle gaps between the undesired particles 35, thereby yielding the desired agglomerate. The particles 40 provide charge carriers that can migrate through the agglomerate in response to the voltage drop across the agglomerate. In this manner, the additive particles can reduce undesired particle resistivity by as much as two orders of magnitude for temperatures above about 260° C. (500° F.). The lower resistivity commonly results in improved precipitator performance, improved particulate collection, reduced sparking in the agglomerate, and lower stack opacity.

Referring to FIGS. 2–4, the agglomerate can be removed from the collection plate 28 by many techniques, including rapping of the collection plate 28 and sonic horns. The preferred methodology for agglomerate removal involves vibration of the collection plate 28. When the collection plate 28 is vibrated, the agglomerate separates from the collection plate 28 in large sheets and falls into the hoppers 18 for disposal. Unlike other additives, the organometallic compound and its derivatives do not increase the set time of concrete made from the removed agglomerate.

EXPERIMENTAL

The protocol for the tests set forth below had two stages. In the first stage, flyash was conditioned dynamically in a heated spray chamber, simulating actual injection conditions. In the second stage, the resistivity of the conditioned flyash was measured at multiple temperature intervals in the same test fixture.

In the first stage, flyash conditioning was performed under carefully controlled conditions. A constant flow of hot, moist carrier gas (air at constant 10% moisture) was maintained through the spray chamber and a downstream filter chamber. Flyash was metered into the spray chamber from the top of an AccuRate screw feeder at a rate of approximately 5 gm/minute. The flyash was then entrained into the carrier gas flow and dispersed throughout the spray chamber. Dilute liquid additive was sprayed into the spray chamber in a co-current direction with entrained flyash and carrier gas. The injected chemical was finely atomized with a dual-fluid atomizing spray nozzle with compressed air as the motive fluid. For all additives, the injection rate was set between 1–3 ml/minute of a 0.0125 gm/ml solution of chemical in distilled water. The liquid flow rate realistically simulated additive concentrations of actual full-scale injection conditions. The heated flyash and the additive spray were mixed with the hot, moist carrier gas in the spray chamber and then were collected onto a high efficiency fabric filter located immediately downstream. Surface heaters around the spray chamber produced a stable gas and interior chamber surface temperature to as high as 450° C. (850° F.). The heaters were controlled through two zones of automatic temperature control. Further temperature control was provided by an inlet humidification chamber and surface heaters on the inlet air line. The conditioning phase of each test was run for one hour, then the flow was stopped, heating was discontinued, and the bag filter with collected flyash was removed. The total liquid additive injected and the total flyash collected on the bag filter were measured gravimetrically. From these two measurements, a precise calculation of additive-to-ash weight ratio was made. Due to unavoidable variation in ash feed rate the actual additive-to-ash weight ratio (ATA)for each test varied.

In the second stage, the resistivity of the conditioned flyash was measured using standard techniques. The conditioned flyash was mixed mechanically in the bag and then diluted onto a standard IEEE resistivity test cell with a layer thickness of 0.5 cm. The resistivity cell with ash was placed back onto the spray chamber and electrical connections to the high voltage power supply were fixed. A fresh filter bag was inserted and the filter chamber reassembled and sealed. The chamber was resealed, the system was reheated, and the flow of moist, hot carrier gas was restarted. Turnaround from bag removal to system restart is typically 30 minutes. Once restarted, the flyash layer on the resistivity cell was allowed to rehydrate and the ash temperature was stabilized at the lowest measurement point, typically 220° F. (104° C.). Electrical resistivity was then determined by measurement of electrical current flow across the ash layer at a fixed DC voltage and electric field strength (nominally 4 kv/cm). Temperature was then raised and stabilized at the next measurement point and the resistivity measurement was repeated. Data was taken at multiple points about 50–70° F. (10–21° C.) apart on an ascending curve from 220° F. to 800° F. (104 to 427° C.). There is typically a 30-minute wait between points to equilibrate ash layer temperature.

In interpreting the test results, there are certain inherent limitations and other factors that should be considered. First, the residence time in the hot zone of the spray chamber was typically about 5 to 8 seconds, which is similar to or longer than an actual injection performed upstream of an electrostatic precipitator. Second, after exiting the hot zone of the spray chamber, the flyash is contacted with the additive on a filter bag downstream at a temperature of no more than 420° F. (216° C.). Third, the collected flyash is cooled, allowing a temperature excursion through the moisture dewpoint. Fourth, flyash is sealed in a 5 gallon bucket before use, but no attempt is made to maintain exact moisture content in the stored ash. Typically, the surrounding air is very dry and the ash reaches a near-constant desiccated condition. Moisture content of the flyash is not considered significant for hot-side comparative tests but can be important when measuring resistivity at cold side temperatures (less than about 400° F. (204° C.)). Fifth, the effect of reactive minor constituents of the flue gas (under actual conditions), such as $SO_x$ and $NO_x$, is not adequately simulated in the resistivity tests. Although such constituents can impact the performance of the additive, especially under cold-side conditions, it is not expected that these constituents would have a significant effect under hot-side conditions. Finally, when measuring very low resistivity with the resistivity test fixture, there was a noticeable leakage current when the current flow exceeded about 100 mA. In effect, this leakage limited the measured resistivity to no less than about $3\times10^7$ ohm-cm. This condition appears as an apparent lower limit on all resistivity curves. The actual resistivity at the highest temperatures with the more effective additives could be significantly lower than reported.

EXPERIMENT 1

Laboratory resistivity tests were run on flyash samples taken from a utility using sodium acetate, a common organic salt compound. Sodium acetate has a listed thermal decomposition temperature of 324° C. (615° F.), which is an ideal range for in-duct applications. In total, twenty-four individual resistivity tests were conducted.

Figure 5:
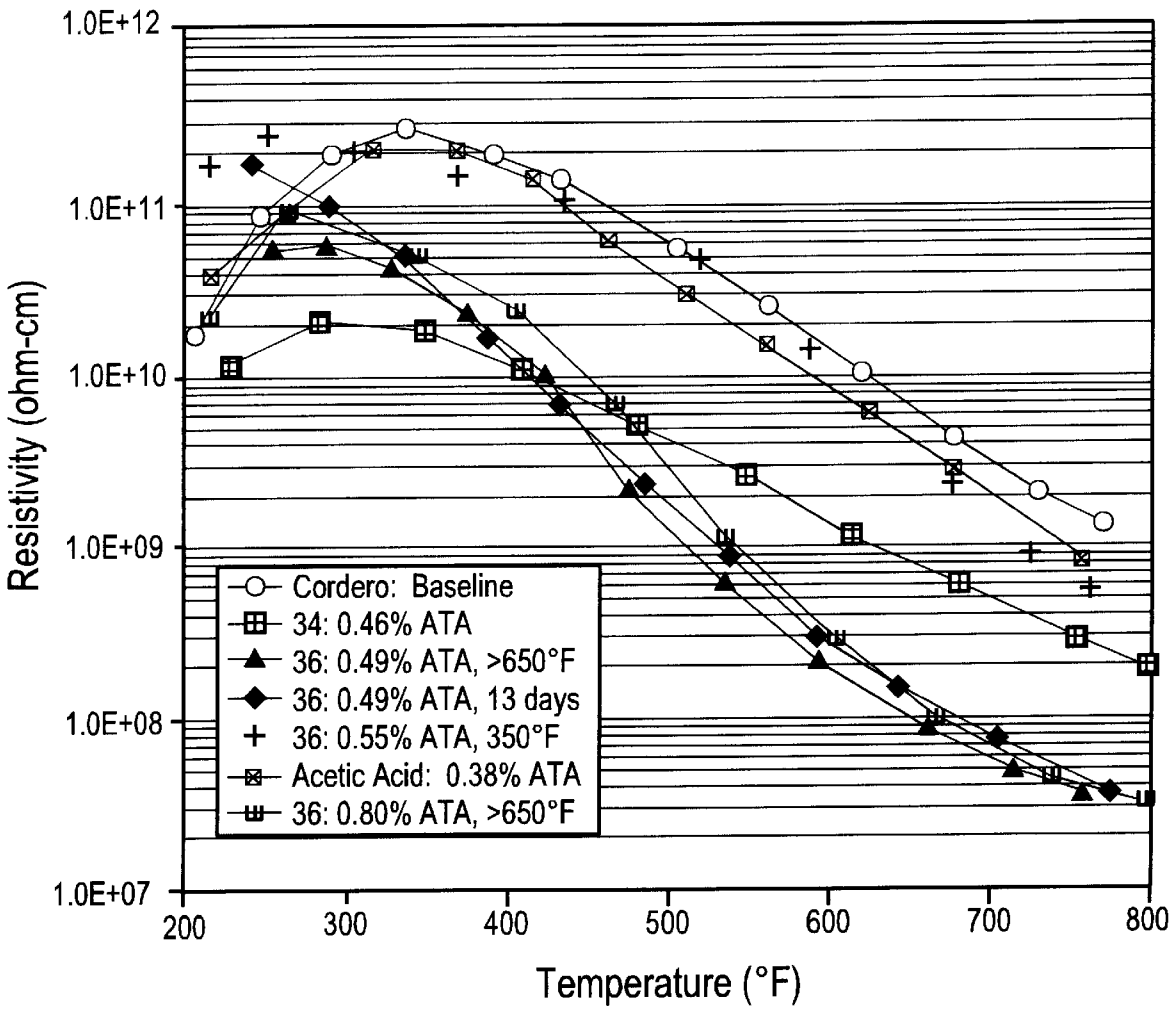
FIG. 5 is a plot of undesired particle resistivity versus temperature for various additives.

Results of the resistivity tests using the sodium acetate additive are shown in FIG. 5. A baseline test with water spray with no additive was also run. Tests with another additive, namely an aqueous monosodium phosphate solution, were run at similar ATA to the sodium acetate tests. In the Figure, "34" refers to the aqueous monosodium phosphate additive; "36" refers to the sodium acetate additive; and "38" refers to the baseline test. Sodium acetate far outperformed the monosodium phosphate additive at higher temperatures. For these tests, the spray chamber gas temperature was controlled at higher than 650° F. (343° C.). A repeat test of the flyash conditioned with sodium acetate was conducted 13 days after the initial run. As can be seen in FIG. 5, the resistivity reduction is long lasting.

EXPERIMENT 2

To determine the resistivity reduction mechanism, further tests were run using acetic acid, a decomposition product of sodium acetate (along with sodium compounds (oxalates, carbonates, and hydroxides)), and sodium formate, a closely related analog compound to sodium acetate but with the simpler formic acid carboxylic group.

A test was run with acetic acid at an introduction rate higher than what could have been generated in the earlier tests if the sodium acetate entirely decomposed. Acetic acid produced no significant reduction in resistivity at any temperature (see FIG. 5). Next, sodium acetate was injected at a spray chamber temperature of 350° F. (177° C.), well below the known decomposition temperature of 615° F. (324° C.). This test showed no resistivity reduction compared to baseline until above 600° F. (316° C.) (FIG. 5). While not wishing to be bound by any theory, the molecular decomposition of the sodium acetate on the resistivity cell ash layer is believed to be responsible for the lower resistivity at higher temperature. However, the response is minimal compared to the same additive when injected above the decomposition temperature.

To avoid corrosion and other problems caused by the release of acetic acid through decomposition of the sodium acetate, it is possible to decompose sodium acetate to other end products. By way of example, soda lime can be reacted with the sodium acetate to yield methane and sodium carbonate.

EXPERIMENT 3

Figure 6:
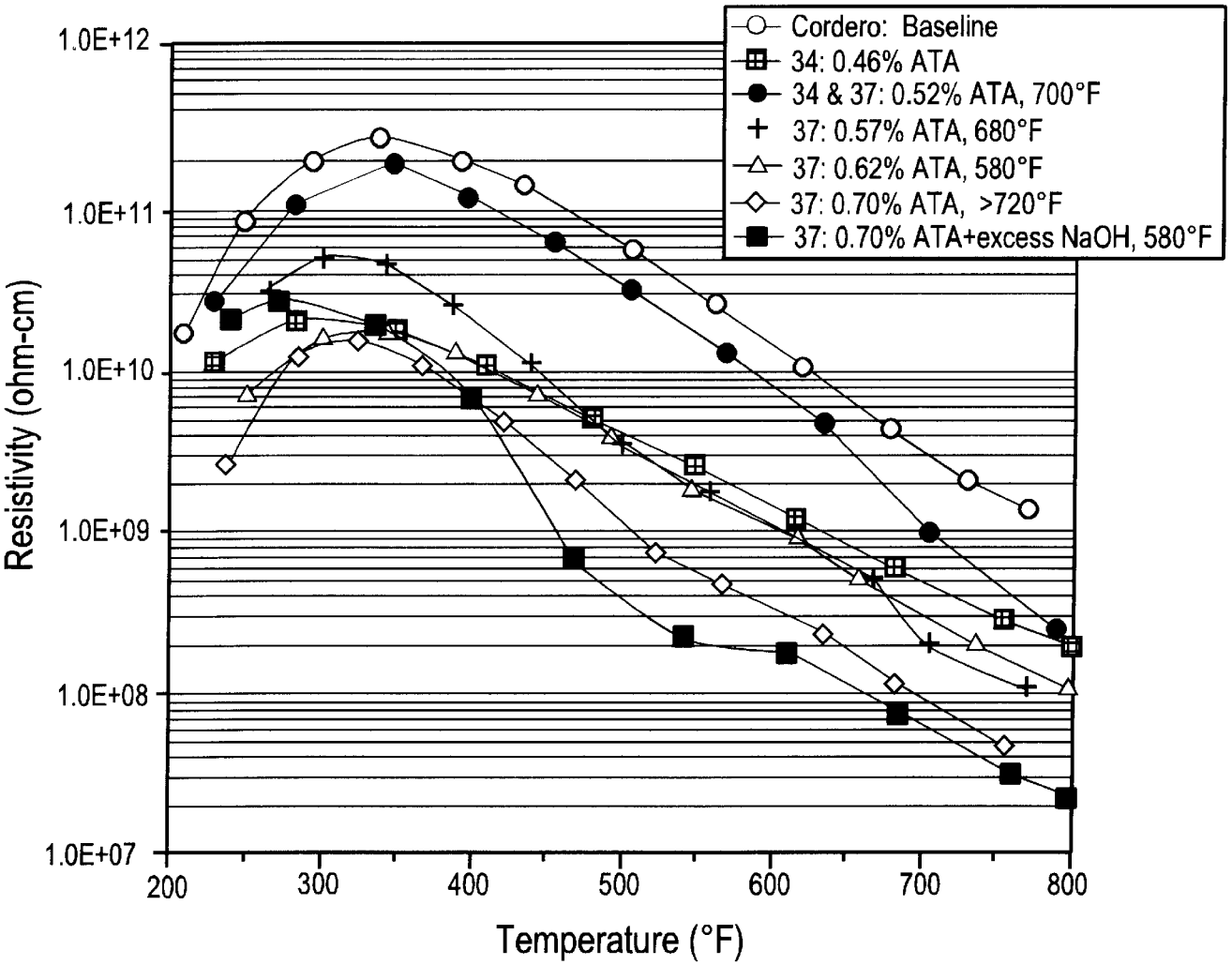
FIG. 6 is a plot of undesired particle resistivity versus temperature for various additives.

Resistivity tests were also run with a flyash which was not effectively conditioned by other additives. Tests were run with no conditioning (baseline), monosodium phosphate (denoted by "34"), sodium hydroxide injected as a liquid additive, and sodium acetate (denoted by "36"). As seen in FIG. 6, sodium acetate is significantly more effective in reducing the resistivity of this flyash than the other additives. Surprisingly, sodium hydroxide, when injected by itself, was the least effective of the additives. It is also believed that the direct introduction of other decomposition products, such as oxalates and carbonates, would prove less effective than sodium acetate alone.

EXPERIMENT 4

Figure 7:
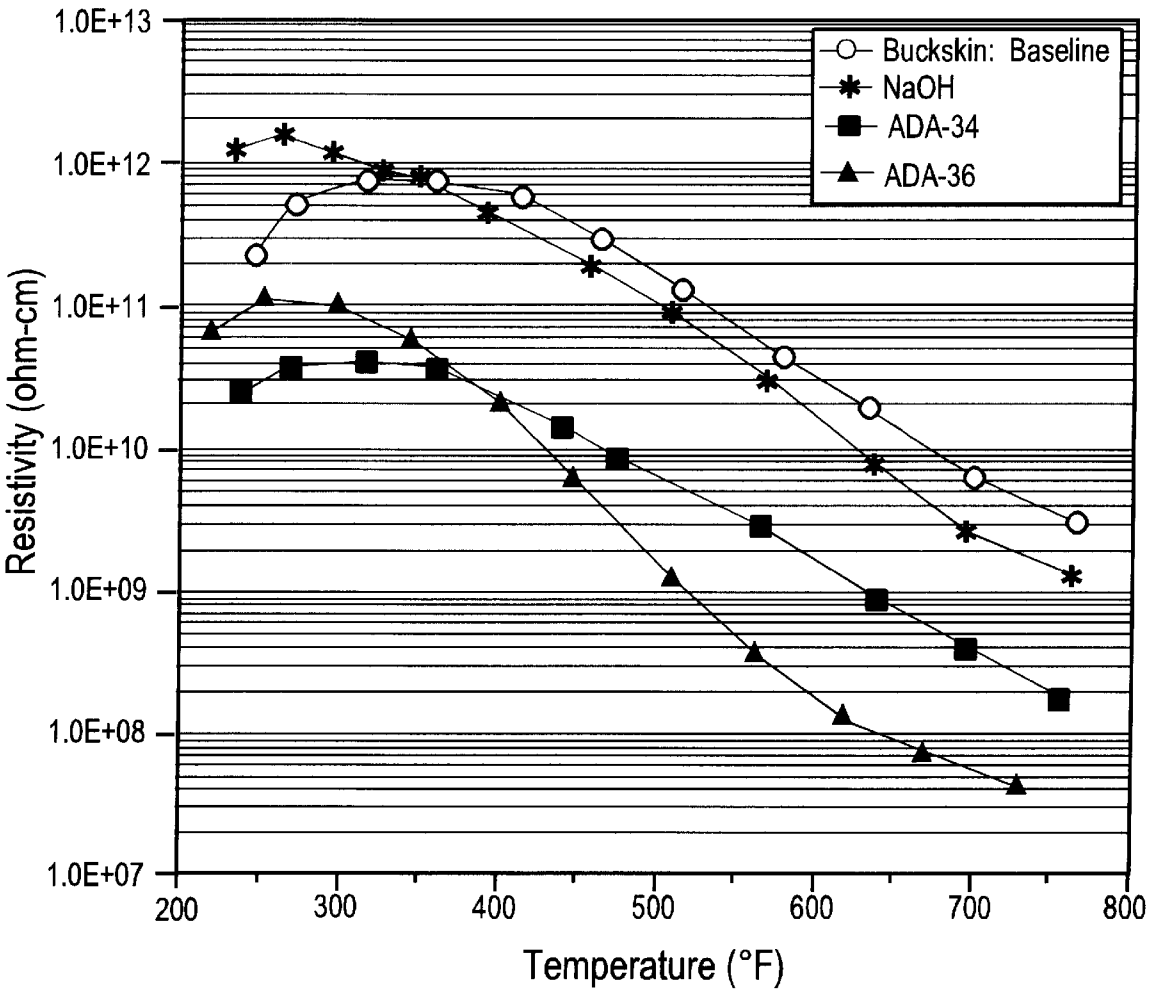
FIG. 7 is a plot of undesired particle resistivity versus temperature for various additives.

Further experiments were conducted with other common monocarboxylic acid salts, as seen in FIG. 7. The additives were: sodium acetate (denoted by "36"), sodium formate (denoted by "37"), sodium propionate (denoted by "38"), potassium acetate (denoted by "39"), and potassium formate (denoted by "40"). The resistivity was reduced by up to two orders of magnitude compared to baseline using sodium formate and sodium acetate when injected into a simulated flue gas stream above the thermal decomposition temperature of each compound (i.e., 360° C. and 324° C., respectively). The potassium compounds also showed good resistivity response at temperatures above 600° F. The thermal decomposition temperatures of potassium acetate and of potassium formate are likely higher than that of sodium acetate. Sodium propionate, the next higher monocarboxylic acid salt above sodium acetate and also having a thermal decomposition temperature that is likely higher than that of sodium acetate, was significantly less effective than sodium acetate and sodium formate.

It was attempted to blend either sodium acetate or sodium formate at a 1:1 ratio with the monosodium phosphate additive. The blend with monosodium phosphate and sodium acetate evolved acetic acid and a white precipitate, likely $Na_2HPO_4$. This blend was not injected into the gas stream. The blend of sodium formate and monosodium phosphate remained a clear liquid but the performance of the combination was worse than for either compound alone (see FIG. 8). Only at temperatures near 700° F. (370° C.) did the resistivity response improve. Accordingly, monosodium phosphate and slightly basic carboxylic acid salts do not appear to be compatible.

EXPERIMENT 5

Sodium formate was selected for further investigation. It has greater solubility in water and a lower freezing point than sodium acetate. It may decompose to sodium oxalate, then to sodium carbonate and carbon monoxide/dioxide and not evolve formic acid. The only possible disadvantage is that the decomposition temperature is 680° F. (360° C.), which is relatively high for many hot-side processes that must cycle to as low as 500° F. (260° C.) gas temperature at low load.

To reduce the decomposition temperature of sodium formate, sodium hydroxide was blended with the sodium formate at a 1:1 molar ratio to reduce the decomposition temperature to 275° C. (515° F.). Sodium hydroxide reacts with the sodium formate according to the following equation:

$$HCOONa+NaOH \rightarrow Na_2CO_3+H_2$$

The additive blend of sodium formate and sodium hydroxide was injected at a temperature between 515° F.

Figure 8:
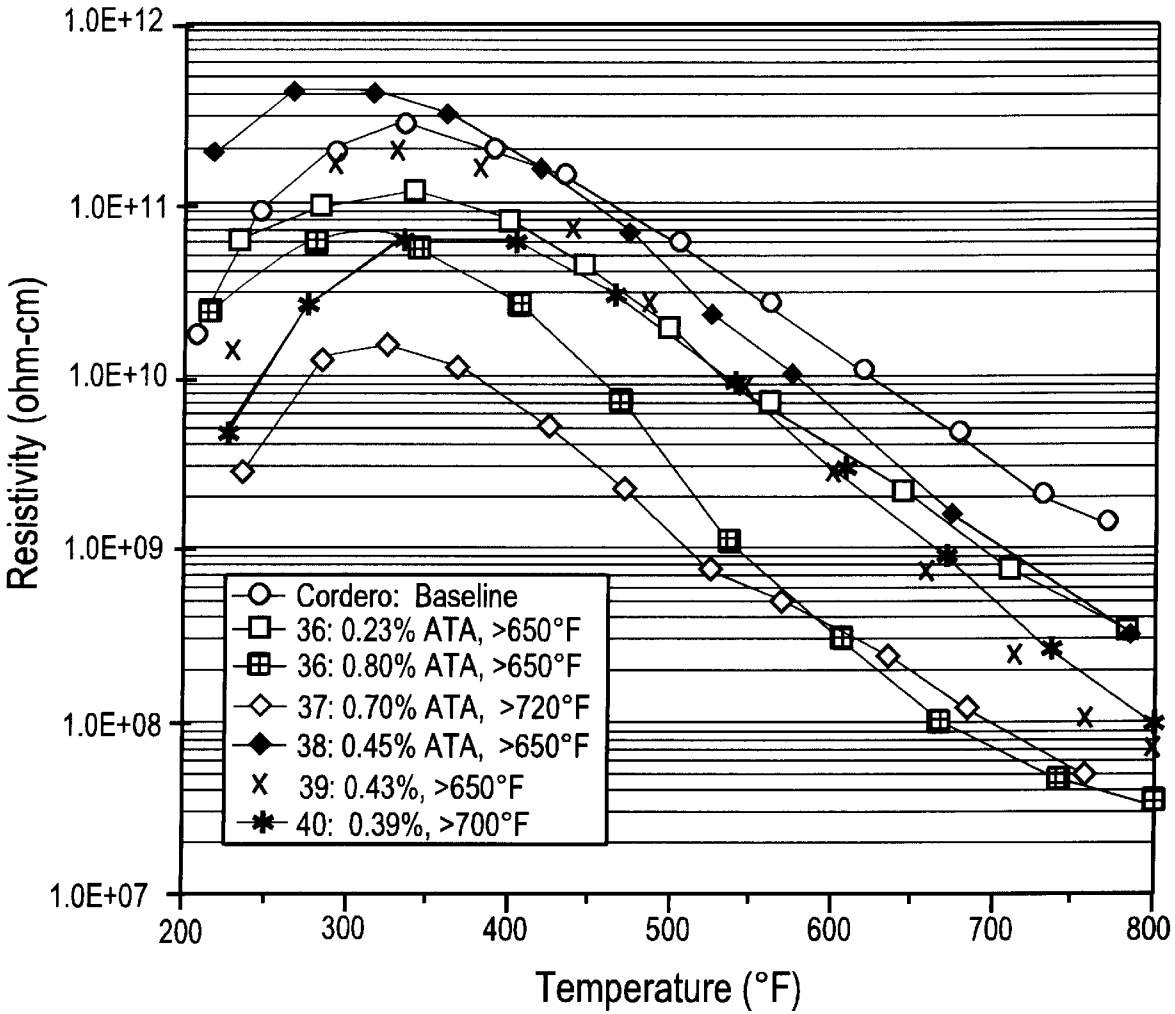
FIG. 8 is a plot of undesired particle resistivity versus temperature for various additives.

(275° C.) and 680° F. (360° C.). The test with excess caustic and sodium formate was run at a chamber gas temperature of 580° F. (304° C.). Measured resistivity for this test was lower than that for any other test, as seen in FIG. 8. This measured resistivity indicates that the desired reaction did occur either in the spray chamber or after the flyash layer on the resistivity cell was reheated.

The sodium formate/caustic soda blend proved very effective at lower temperatures. As a final test, sodium formate alone was injected at 0.62% ATA and 580° F. (304° C.), below its thermal decomposition temperature. Compared to the best run of sodium formate with excess caustic soda, resistivity of the sodium formate alone was nearly an order of magnitude higher.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A process for removing undesired solid particles from a gas stream containing undesired solid particles, comprising:

contacting a composition with the gas stream, the composition comprising an organometallic compound having a thermal decomposition temperature that is less than the temperature of the gas stream wherein a metal in the organometallic compound is monovalent;

collecting on at least one collection surface in a particulate collection zone a solid agglomerate including at least a portion of the composition or a derivative thereof and at least most of the undesired solid particles in the gas stream, wherein the at least one collection surface is at least one electrode and the at least a portion of the composition or a derivative thereof alters the resistivity of at least most of the undesired particles collected on the at least one collection surface; and removing the agglomerate from the at least one collection surface.

2. The process of claim 1, wherein the composition includes at least about 0.1% by weight of the organometallic compound.

3. The process of claim 1, wherein the organometallic compound is a carboxylic acid salt.

4. The process of claim 3, wherein the carboxylic acid salt is selected from the group consisting of a metal acetate, a metal formate and mixtures thereof.

5. The process of claim 3, wherein the composition includes from about 0.1 to about 50% by weight of the carboxylic acid salt.

6. The process of claim 1, wherein the composition further includes a carrier fluid that vaporizes in the gas stream.

7. The process of claim 6, wherein at least most of the carrier fluid vaporizes before the organometallic compound or a derivative thereof contacts the at least one collection surface.

8. The process of claim 6, wherein the concentration of the organometallic compound in the carrier fluid ranges from about 0.1 to about 50% by weight.

9. The process of claim 1, wherein the organometallic compound has a melting point that is less than the temperature of the gas stream.

10. The process of claim 1, wherein the composition further indicates a decomposition agent to cause decomposition of the organometallic compound after contact of the organometallic compound with the gas stream.

11. The process of claim 10, wherein the decomposition agent is an alkali metal hydroxide.

12. The process of claim 10, wherein a boiling point of the decomposition agent is more than the gas stream temperature.

13. The process of claim 1, wherein the at least one collection surface is located upstream of an air preheater.

14. The process of claim 1, wherein the temperature of the gas stream is at least about 100° C.

15. The process of claim 1, wherein the collecting step includes the substep of imparting an electrical charge to the undesired particles and particles of the composition and electrically attracting the electrically charged particles to the at least one collection surface.

16. The process of claim 1, wherein the collecting step includes filtering the undesired particles and particles of the composition from the gas stream.

17. An additive for improving charge conduction in electrostatically collected undesired solid particles under hot-side conditions, comprising:

(a) at least about 0.1% by weight of a metal salt of a caboxylic acid;

(b) a vaporizable carrier fluid; and (c) a decomposition agent to cause decomposition of the metal salt after contact of the metal salt with the gas stream, wherein the metal salt or a derivative thereof alters the resistivity of the electrostatically collected undesired solid particles.

18. The additive of claim 17, wherein the metal salt has a thermal decomposition temperature ranging from about 260 to about 480° C.

19. The additive of claim 17, wherein the additive includes from about 0.1 to about 50% by weight of the metal salt.

20. The additive of claim 17, wherein the metal salt is selected from the group consisting of a metal acetate, a metal formate, a metal propionate and mixtures thereof.

21. The additive of claim 17, wherein the additive includes from about 50 to about 99.9% by weight of the carrier fluid.

22. The additive of claim 17, wherein the decomposition agent is an alkali metal hydroxide.

23. The additive of claim 17, wherein the additive includes from about 1% to about 20% by weight of the decomposition agent.

24. A process for removing undesired solid particles from a gas stream containing undesired solid particles, comprising:

contacting with said gas stream a composition including an organometallic compound, wherein at least most of the metal of the organometallic compound that is contained in the composition is selected from the group consisting of sodium, potassium, lithium, and mixtures thereof; and electrostatically collecting at least most of said undesired solid particles and at least a portion of the organometallic compound or a derivative thereof on a collection surface to form on said collection surface a solid agglomerate including the undesired solid particles and the organometallic compound or a derivative thereof, wherein the collection surface is located between a combustion zone and a heat exchanger and wherein the organometallic compound or a derivative thereof alters the resistivity of at least most of the undesired solid particles collected on the collection surface.

25. The process of claim 24, wherein the organometallic compound is a metal salt and the metal salt is selected from the group consisting of a metal salt of a carboxylic acid or a precursor thereof and has a thermal decomposition temperature ranging from about 260 to about 480° C.

26. The process of claim 25, wherein the composition includes from about 0.1 to about 50% by weight of the metal salt thereof.

27. The process of claim 25, wherein the metal salt is selected from the group consisting of a metal acetate, a metal formate, a metal propionate and mixtures thereof.

28. The process of claim 25, wherein the composition includes from about 50 to about 99.9% by weight of a carrier fluid.

29. The process of claim 24, wherein the composition further includes a decomposition agent to cause decomposition of the oganometallic compound after contact of the organometallic compound with the gas stream.

30. The process of claim 29, wherein the decomposition agent is an alkali metal hydroxide.

31. The process of claim 29, wherein the composition includes from about 1% to about 20% by weight of the decomposition agent.

32. A system for removing undesired solid particles from a gas stream containing undesired solid particles, comprising:

a housing;

an input for introducing an input gas stream into the house;

an output for removing an output gas stream from the housing;

an additive contacting means for contacting with the input gas stream a composition including an organometallic compound having a thermal decomposition temperature less than the temperature of the gas stream and wherein a metal in the organometallic compound is manovalent; and an electrostatic collection surface positioned in the housing between the input and the output to collect on the collection surface at least a portion of the undesired solid particles and at least a portion of the composition contacted with the input gas stream or a derivative thereof and wherein the organometallic compound or a derivative thereof alters the resistivity of the undesired solid particles collected on the collection surface.

33. The system of claim 32, wherein the collection surface is a collecting electrode and further comprising:

a power supply having positive and negative terminals;

at least one charging electrode electrically connected to a terminal of the power supply and positioned in the housing relative to the input gas stream to impart a charge to the undesired particles and composition particles in the input gas stream; and the electrostatic collection surface is electrically connected to the other of the terminals ofthe power supply and is positioned in the housing relative to the charging electrode to accumulate the charged particles on the electrostatic collection surface.

34. The system of claim 32, wherein the organometallic compound is a metal salt of a carboxylic acid and is selected from the group consisting of a metal acetate, a metal formate, a metal propionate and mixtures thereof.

35. The system of claim 32, wherein the composition further includes a decomposition agent to induce decomposition of the organometallic compound in the input gas stream.

36. The system of claim 35, wherein the decomposition agent is an alkali metal hydroxide.

37. A process for removing solid particles from a gas stream containing solid particles, comprising:

contacting with the gas stream a composition comprising (a) an organometallic compound having a thermal decomposition temperature that is less than the temperature of the gas stream wherein a metal in the organometallic compound is monovalent and (b) a decomposition agent to cause decomposition of the organometallic compound after contact thereof with the gas stream;

collecting on at least one collection surface in a particulate collection zone a solid agglomerate including at least a portion of the composition or a derivative thereof and at least most of the solid particles in the gas stream wherein the at least one collection surface is at least one electrode and the at least a portion of the composition or a derivative thereof alters the resistivity of at least some of the collected solid particles; and removing the agglomerate from the at least one collection surface.

38. The process of claim 37, wherein the organometallic compound is a carboxylic acid salt.

39. The process of claim 38, wherein the carboxylic acid salt is selected from the group consisting of a metal acetate, a metal formate and mixtures thereof.

40. The process of claim 38, wherein the composition includes from about 0.1 to about 50% by weight of the carboxylic acid salt.

41. The process of claim 37, wherein the organometallic compound has a melting point that is less than the temperature of the gas stream.

42. The process of claim 37, wherein the decomposition agent is an alkali metal hydroxide.

43. The process of claim 37, wherein a boiling point ofthe decomposition agent is more than the gas stream temperature.

44. The process of claim 37, wherein the at least one collection surface is located upstream of an air preheater.

45. The process of claim 37, wherein the temperature of the gas stream is at least about 100° C.

46. The process of claim 37, wherein the collecting step includes the substep of imparting an electrical charge to the solid particles and particles of the composition and electrically attracting the electrically charged particles to the at least one collection surface.

47. The process of claim 37, wherein the collecting step includes filtering the solid particles and particles of the composition from the gas stream.

* * * * *